United States Patent [19]

Riley

[11] Patent Number: 4,666,331

[45] Date of Patent: May 19, 1987

[54] INSTANT DEFENSE BARRIER

[76] Inventor: William T. Riley, 880 High Rd., Woodside, Calif. 94062

[21] Appl. No.: 767,299

[22] Filed: Aug. 19, 1985

[51] Int. Cl.[4] ..... E01F 13/00

[52] U.S. Cl. ..... 404/6; 49/49; 256/1

[58] Field of Search ..... 256/1, 13.1, 9; 404/6, 404/11; 49/35, 49

[56] References Cited

U.S. PATENT DOCUMENTS

| | | | |
|---|---|---|---|
| 364,175 | 5/1887 | Hurd | 256/1 X |
| 1,884,447 | 10/1932 | White | 256/1 |
| 2,315,516 | 4/1943 | Gray | 256/1 |
| 3,451,164 | 6/1969 | Kappelman | 49/35 |

FOREIGN PATENT DOCUMENTS

| | | | |
|---|---|---|---|
| 819804 | 7/1937 | France | 256/1 |
| 2495658 | 6/1982 | France | 49/49 |

*Primary Examiner*—Andrew V. Kundrat
*Attorney, Agent, or Firm*—Townsend & Townsend

[57] ABSTRACT

An instant defense barrier for providing unobtrusive protection for a building or other site. A plurality of barrier post assemblies are anchored in the earth. Each assembly includes a barrel and a post slidably fitted in the barrel. The head end of the post portion is essentially flush with the level of the roadbed when the post is in the normal, non-extended position. When activated by closing a switch, the post is propelled from the confined position in the barrel by an explosive charge, a compression spring or other propulsive forces to a locked extended position to provide a barrier against unauthorized passage by a motor vehicle. A plurality of auxiliary cables are optionally connected between adjacent posts to provide further obstruction to the progress of small vehicles, such as motorcycles or bicycles.

22 Claims, 18 Drawing Figures

INSTANT DEFENSE BARRIER

This invention relates to barrier systems for obstructing unauthorized access to buildings and areas.

The recent wave of terrorist vehicular bombings in the Middle East represents the current form of a security problem which has existed as long as terrorism itself. In its current form, explosives are loaded onto a motorized vehicle, which is then driven to a target site, typically a building, where the explosives are detonated by the driver. The result has been physical injury and death to personnel at the target site, as well as physical damage to and destruction of the buildings themselves.

Even though the target sites are usually protected by a security gate and sentry system, this arrangement has not been successful in preventing dedicated terrorists from accomplishing their missions, who have graphically demonstrated the ease with which the barriers can be broached. In an effort to thwart such motorized assaults, large concrete cubes have been erected on the roadbed to hinder the progress of the vehicle from the security entrance point to the target building. This solution has not been successful, since the pathway through the staggered concrete cubes must allow the passage of authorized vehicles to the building, so that authorized persons (such as embassy staff, delivery men, and authorized visitors) can have ready access to the building or site. In addition, since many target sites of terrorists' attacks are located in conventional residential areas (e.g., embassy row), the security cube technique is unsightly.

SUMMARY OF THE INVENTION

The invention comprises a defense barrier system which is highly effective in impeding vehicles when activated, but which is hardly noticeable in the armed and ready state, and which is suitable for installation and use in a wide variety of application sites.

In its broadest aspect, the invention comprises a plurality of erectable barrier post assemblies each embedded in the earth, preferably in a concrete foundation, at preselected locations relative to the site to be protected. Each barrier post assembly includes a rigid barrel housing, an erectable post, a post latch and means for propelling the post from a normal position within the housing to an extended position above the surface of the earth, the post being latched in the extended position. The housing has a lower floor portion, an upper mouth portion located adjacent the surface of the earth, a stop member located at a position intermediate the lower floor portion and the mouth portion, and a latch.

The rigid post, which is normally confined within the barrel housing, has a foot portion normally positioned on the lower floor portion of the barrel housing, a head portion normally located adjacent the mouth portion of the barrel housing, and an abutment member engageable with the stop member and the latch when the post is extended above the surface of the earth.

The stop member in the barrel housing is preferably positioned above the latch and comprises a pair of lugs extending inwardly of the inner surface of the barrel housing. The stop member preferably also includes a resilent member mounted on the lower surface in order to cushion the impact with the abutment member when the post is extended.

The foot portion of the post preferably comprises a peripheral flange having a pair of notches each wider than the latch in order to permit the post to be restored to the normal position after extension by rotating the post within the barrel housing until the notches align with the latches.

The latch preferably comprises a lateral blind recess formed in the barrel housing, a slidable latch member received in the recess and means for biasing the latch member inwardly of the barrel housing. The latch further preferably includes a keeper for limiting inward motion of the latch member so as to prevent sliding friction between the inner end of the latch and the outer surface of the post during motion of the post.

In a first embodiment, the propelling means comprises an explosive charge positioned within the barrier post assembly. In one specific embodiment, the explosive charge is suspended from the head portion of the post.

In an alternate embodiment, the propelling means is positioned between the post and the housing for urging the post to the extended position. In a specific embodiment, the post has a hollow interior and a spring is positioned within the hollow interior with the lower end of the spring bearing against the floor portion of the barrel housing.

In the alternate embodiment using the spring propelling means, a trigger latch assembly is installed for releasably latching the post in the normal position, along with means for releasing the trigger latch assembly to enable extension of the post under the power of the spring. In one alternate embodiment, the trigger latch assembly includes a latch member releasably engaged with the post, and the releasing means includes a locked plunger releasably engaged with the latch member and solenoid means for retracting the locked plunger when extension of the post is desired.

In a second alternate embodiment, the trigger latch assembly includes a spring biased pivotally mounted latch stop with a roller bearing abutment member, and the releasing means includes an electromagnet for retracting the latch stop to a release position.

In addition, in the alternate embodiment using the spring propelling means, means are provided for forcibly retracting the post within the housing after the post has been extended and the reason for extending the post no longer exists. Specifically, in the preferred embodiment the retracting means includes a flexible cable secured at one end to the lower floor portion of the housing and coupled at the other end to the head portion of the post by means of an external ring positioned in a recess in the top surface of the head portion of the post. A cable reel is provided within the post in order to take up slack in the cable when the post is in the retracted position, the cable reel being preferably a spring loaded reel. A detachable winch is provided, which is adapted to be placed on the exposed surface of the head portion of the post, the winch having a hook for engaging the upper end of the flexible cable.

To further enhance the effectiveness of the invention, a plurality of cables are connected between preselected ones of the individual posts. When the posts are extended, the cables are raised to provide one or more horizontal barriers in the interstices between the posts.

When installed in the earth in the normal position, the barrier post assemblies are no more noticeable than conventional highway markers. However, when extended, the posts lock in place and provide a formidable barrier to the progress of a vehicle. When the auxiliary cables are employed, additional protection is provided against the intrusion of motor vehicles and even motorcycles, motor scooters and bicycles.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
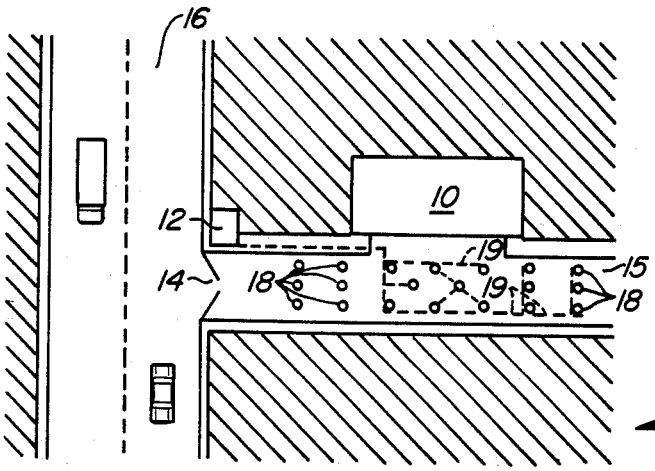
FIG. 1 is a schematic aerial view of a site protected by the invention.

Turning now to the drawings, FIG. 1 illustrates in schematic aerial form a representative installation of the invention. As seen in this Fig., reference numeral 10 designates a building to be protected from assault, and reference numeral 12 designates a sentry post, illustrated as being adjacent a security gate 14. Building 10 is situated on a secondary street 15 connected to a main arterial 16.

Embedded within the roadbed of secondary road 15 are a plurality of barrier post assemblies 18, described in detail below. The individual barrier post assemblies 18 are electrically interconnected to the sentry post 12 by electrical conduit, preferably underground conduit as suggested by the broken lines 19. Thus, barrier post assemblies 18 may be controlled by the staff of sentry post 12. Control of barrier post assemblies 18 is effected by means of one or more manually operable switches. It is understood that the configuration of FIG. 1 is merely illustrative and that other configurations are possible. For example, control of the barrier post assemblies 18 could also be effected from within building 10 by similar electrical connections; or two separate and independent sets of electrical control connections may be made: one to the sentry post 12, the other to the main building 10. Still further, other sentry posts may be provided, for example at the right end of secondary road 15, to which electrical connections are made from the barrier post assemblies 18.

As will be described below in more detail, each barrier post assembly 18 is capable of being rapidly extended from a normal position, in which each post is retracted so that the head portion is at the level of the road surface (or the surface of the earth where no roadbed is provided) to a fully extended and locked position in which the post extends to a height in the vertical direction sufficient to interfere with the progress of any moving vehicle. By providing multiple rows of posts and intermixing the posts in a matrix, a rapidly deployable highly effective defense barrier can be erected to impede and stop the progress of any moving vehicle. However, when in the normal retracted position, the barrier system does not interfere with the orderly flow of traffic along the secondary road 15.

FIGS. 2A, 2B and 3–5 illustrate a first embodiment of an individual barrier post assembly fabricated according to the invention. As seen in these Figs., each assembly 18 is embedded in a concrete foundation 21 extending from the surface of the roadbed 15 to a suitable depth below this surface in order to accommodate the barrier post assembly 18. The outer housing portion of each barrier post assembly 18 comprises a barrel like housing structure 22 having a floor portion 23, an upstanding wall portion 24 extending from the floor portion 23 to the region of the roadbed 15, and an upper mouth portion having a central aperture 26 of smaller diameter than the diameter of the wall portion 24.

Figure 4:
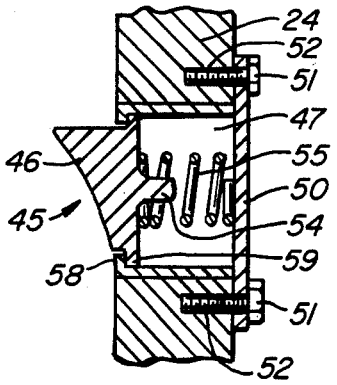
FIG. 4 is an enlarged view of the right latch assembly of FIG. 2A.
Figure 5:
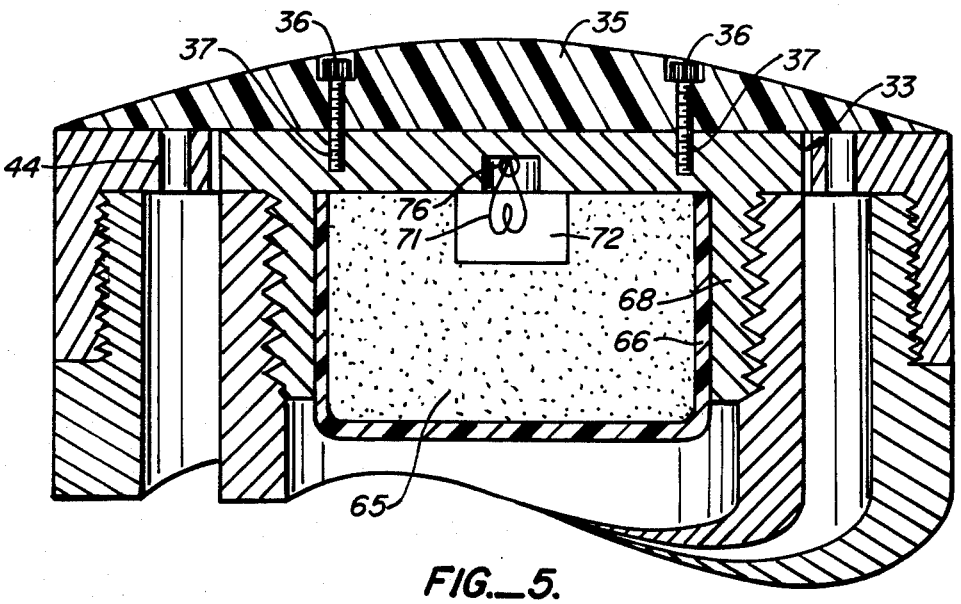
FIG. 5 is an enlarged sectional view of the upper end of the barrier post assembly of FIG. 2A.

Slidably located within the housing 22 is a post 30 having an enlarged foot portion 31, a longitudinally extending wall portion 32 and a head portion generally designated with reference numeral 33. In the embodiment shown in FIGS. 2A, 2B and 3–5, the head portion is crowned with a partially spherical protective cap 35 which extends over the top surface of the head portion 33 of post 30 and the mouth portion of the housing 22 to provide a shield against water, dirt and other debris entering into the interior of the assembly. As best seen in FIG. 5, protective cap 35 is secured to the head portion by means of a pair of bolts 36 recessed into the surface of cap 35 and engaged in threaded bores 37 formed in the upper wall of head portion 33.

Located within the interior of wall portion 24 is a mechanical stop 39 preferably formed as an annulus, either integral with or secured to the inner wall surface of wall portion 24. The stop is provided with a layer of resilent cushioning material 41 on the lower surface thereof to cushion the impact of the foot portion 31 of the post when extended in the manner described below. In order to reduce the fluid flow resistance within the housing 24 during upward motion of the post 30, a set of bleedholes 43 is formed in the stop 39, and a set of additional bleedholes 44 is formed in the mouth portion of the housing 22.

Positioned below the stop member 39 are a pair of post latch assemblies 45 illustrated in enlarged detail form in FIG. 4. As seen in this Fig., latch assembly 45 includes a latch member 46 slidably arranged within a recess 47 formed in the housing wall portion 24 and closed off by means of an end plate 50 secured by means of fasteners 51 received in threaded apertures 52. Latch member 46 has a laterally extending locating member 54 about which a spring 55 is received. Spring 55 urges latch member 46 in the inward direction of the housing and the latch member is designed to be momentarily retracted by the foot portion 31 of post 30 as the post moves upwardly within the bore of housing 22. In order to limit the inward direction motion of latch member 46, a stop aperture 58 is provided with a smaller diameter than the diameter of the flange portion 59 of latch 46.

Figure 2A:
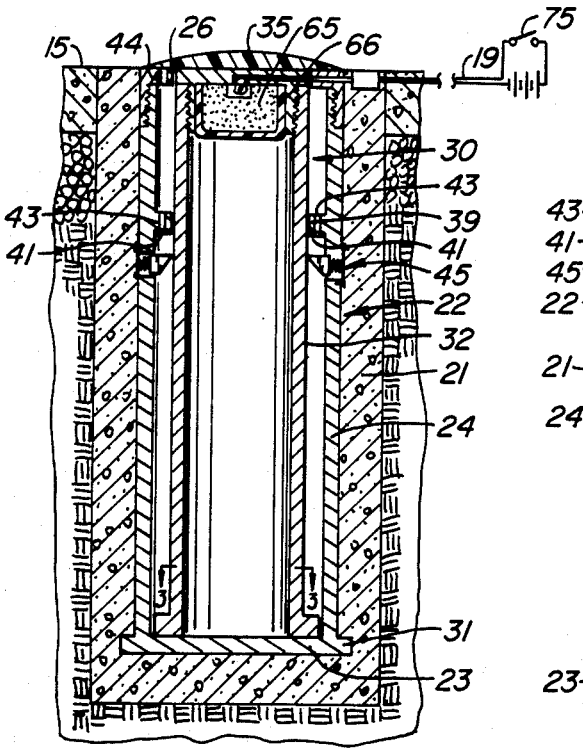
FIG. 2A is a vertical cross-section of a first embodiment of the invention in the normal position.
Figure 2B:
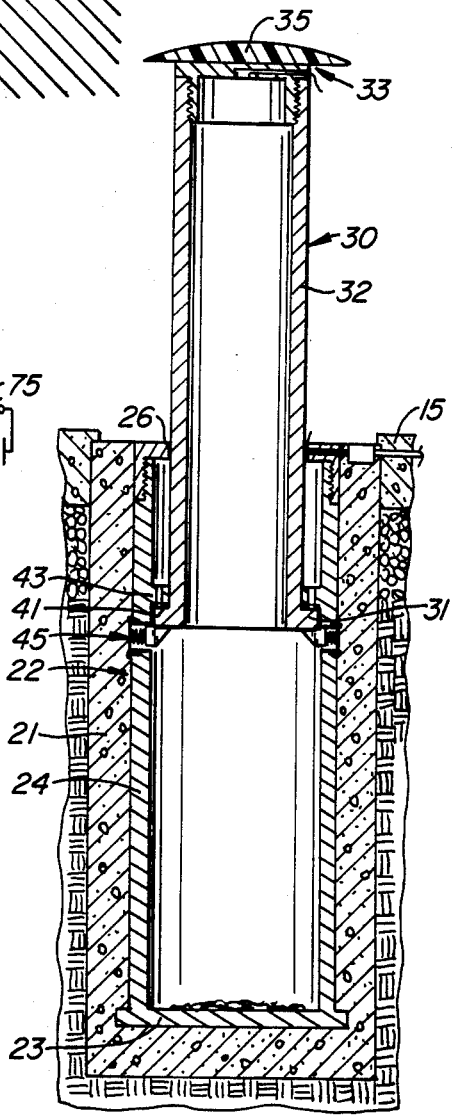
FIG. 2B is a vertical cross-section of the first embodiment of the invention in the extended position.
Figure 3:
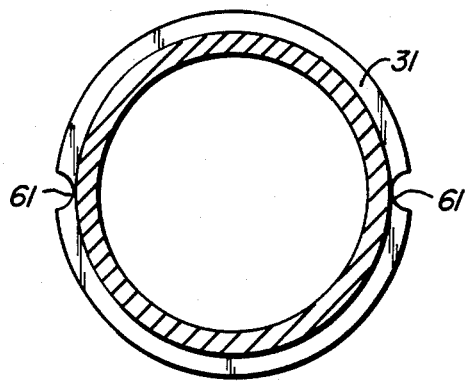
FIG. 3 is a sectional view taken along the lines 3—3 of FIG. 2A.

In order to enable the post to be lowered to the normal position after having been elevated to the extended position illustrated in FIG. 2B, foot portion 31 of the post 30 is provided with a pair of notches 61 (FIG. 3) which are wide enough to bridge the width of each latch member 46. Notches 61 also function to provide fluid pressure relief when the post is being manipulated downward to the normal position.

Figure 6:
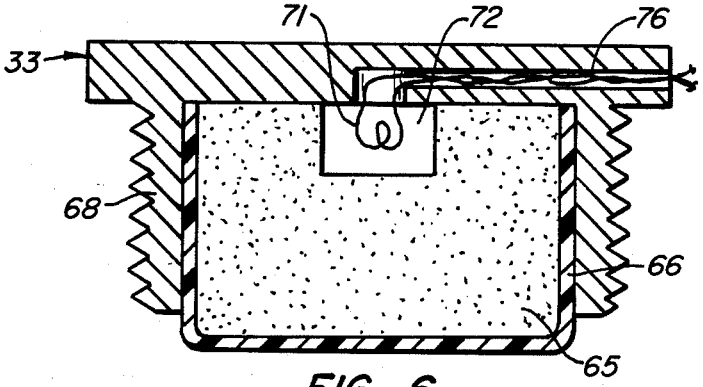
FIG. 6 is a view similar to FIG. 5 of an alternate embodiment of the invention of FIG. 2A.

In the embodiment shown in FIGS. 2A, 2B and 3–5, propulsion for the post is provided by an explosive charge 65 contained in a closure cap 66 wadded into a central cavity formed by externally threaded downwardly depending concentric wall 68 of head portion 33. A detonator 71 is positioned within the charge 65 in a small recess 72 and is coupled to the actuating switch 75 by means of two wire electrical conduit 19. As seen in FIG. 6, the conduit 19 may be passed through a radially extending bore 76 formed in the cap portion of head portion 33.

FIG. 6 also illustrates a variation of the head portion 33 in which the protective cap 35 is not present.

The barrier post assembly is installed below the surface of the roadbed 15 by preparing an appropriate cavity, positioning the assembly within the cavity and pouring the concrete foundation. As suggested by FIG. 1, the cavities should be formed at appropriate spacings in order to prevent the passage therebetween of larger motor vehicles.

Once installed, each barrier post assembly is normally configured in the manner shown in FIG. 2A, i.e., in the retracted state with the top surface of the head portion 33 essentially level with the surface of housing 22, the top surface of the concrete foundation 21 and the top surface of the roadbed 15. Some elevational variation may be permitted among these elements without affecting the operation of the invention. With the protective cap 35 in place, the installed barrier post assemblies provide a slight bumpiness to the surface of the roadbed which is no more noticeable than ordinary highway markers.

When the explosive charge 65 is fired by closing the actuating switch 75, the expanding gasses within the hollow center of post 30 rapidly force the post upwardly out of the housing 22. As the foot portion 31 reaches the latch assembly 45, each latch member 46 is momentarily retracted by the outer surface of the foot portion 31, and then extended inwardly by the action of the spring 55. The post 30 is restrained in its upward movement by the stop 39, and the extended latch members 46 prevent post assembly 30 from falling back to the normal position, thereby locking the post in place in the extended position. The impact of the upper surface of foot portion 31 against the stop 39 is cushioned by the resilent layer 41.

Once locked in place, the post 30 presents a relatively rigid barrier against a moving vehicle. The extent of the rigidity depends upon the structural materials from which the post 30 and housing 22 are fabricated, the relative dimensions of the wall thicknesses and overall diameter, and the lateral support points afforded for post 30 by the mouth and stop portions of housing 22. For maximum strength, the post 30 and housing 22 are preferably fabricated from extruded steel pipe having appropriate diameters and wall thickness. Generally, these dimensions can best be selected on an empirical basis from commercially available pipe with diameters in the range from about an inch to ten inches and wall thickness in the range from about one-quarter inch to about one and three-quarters inches. Other materials may also be effective.

Once extended, the post 30 will remain in the positioned illustrated in FIG. 2B until the reason for the actuation no longer exists. At that time, the post can be simply retracted by rotating the post 30 about its longitudinal axis until the notches 61 align with the latch members 46, thereby permitting the foot portion 31 to pass downwardly through the latch assembly region. The charge may be replaced by unscrewing the head portion 33 from the wall portion 32 of the post 30 and inserting a new charge and replacing the detonator 71, if consumed.

Figure 8:
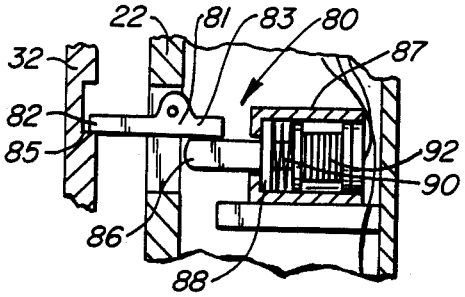
FIG. 8 is an enlarged view of the trigger latch assembly of the FIG. 7A embodiment.
Figure 7A:
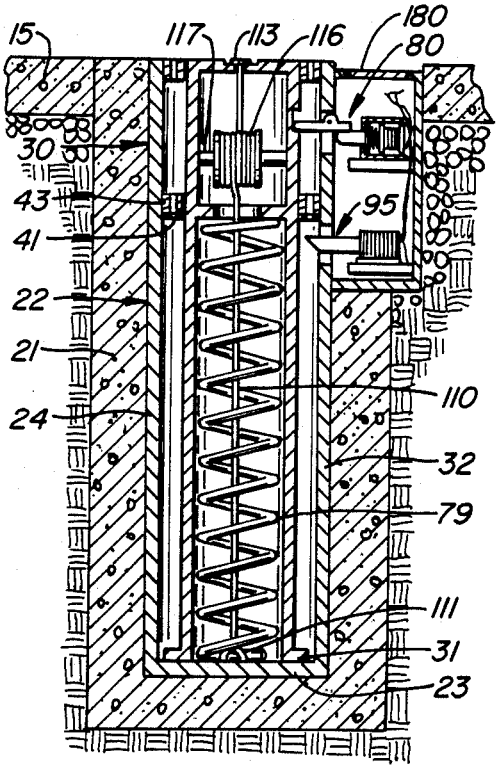
FIG. 7A is a vertical sectional view of an alternate embodiment of the invention in the normal position.

FIGS. 7A, 7B, 8 and 9 illustrate an alternate embodiment of the invention in which propulsion is effected by means of a strong compression spring 79 which is compressed when in the normal position illustrated in FIG. 7A. In order to retain post 30 in the retracted normal position, a trigger latch assembly 80 is provided. As best seen in FIG. 8, trigger latch assembly 80 includes a trigger arm 81 pivotably mounted in an opening formed in wall portion 22 of housing 30, the trigger arm 81 having an operating end 82 and an operated end 83. Trigger arm 81 is spring biased in the counter-clockwise direction as viewed in FIG. 8 by an appropriate spring arrangement in a convention manner. Operating end 82 is normally engaged with a notch 85 or other abutment formed in or secured to post wall 32. The operated end 83 is normally engaged with a retractable plunger 86 positioned within a plunger cylinder 87. Plunger 86 has an enlarged piston portion 88 fabricated from a magnetizable material, and is normally urged in a radially inward direction by means of a compression spring 90 positioned between plunger piston 88 and one end of a solenoid coil 92. The right end of plunger 86 as viewed in FIG. 8 extends partially within the solenoid coil 92 so as to be attracted to the right when the coil is energized.

Mounted below the trigger latch assembly 80 is a second solenoid operated latch assembly 95 which functions in a manner similar to latch assembly 45 of the first embodiment described above.

In use, with the post 30 in the fully retracted position illustrated in FIG. 7A, trigger arm 81 bears against notch 85 and is restrained against pivotal rotation by plunger 86. When solenoid 92 is operated, the working end of plunger 86 is retracted in the radially outward direction, thereby freeing trigger arm 81 to rotate under the upward force transmitted by the spring. As a consequence, post 30 is extended by the force of the spring 79 in the upward direction until the foot portion 31 engages the stop 39 in housing 22. Thereafter, the latch assembly 95 maintains post 30 in the extended locked position.

To facilitate retraction of the post 30 to the normal position, a flexible cable 110 is anchored at the lower end to an eyebolt 111 secured to the upper surface of floor portion 23. The upper end of cable 110 is connected to a ring 113 accommodated in a recess 114 formed in the top surface of head portion 33. Within the interior of post 30, cable 110 is wound around a conventional spring loaded reel 116 which is rotatably mounted on a spindle 117 located in the upper region of the hollow interior of post 30. Reel 116 functions to gather up slack portions of the cable 110 when the post 30 is in the retracted state illustrated in FIG. 7A, and also to enable the post 30 to be drawn down into the interior of housing 22 by means of the winch illustrated in FIG. 9.

Figure 9:
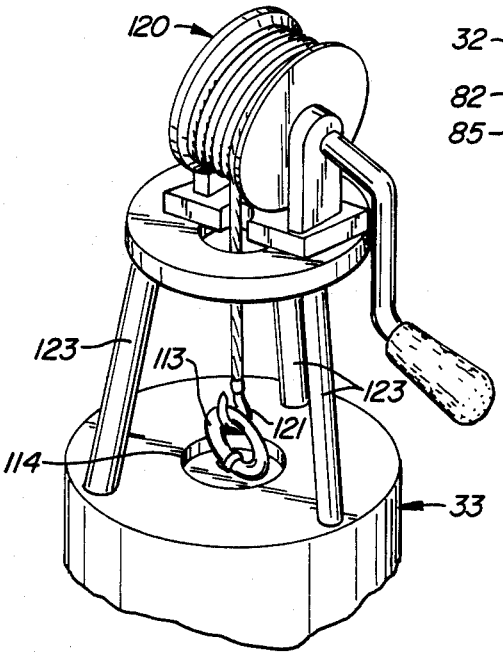
FIG. 9 is a partial perspective view illustrating a winch for retracting the post, once extended.

As seen in FIG. 9, a winch 120 is provided with a cablehook 121 adapted to grasp the ring 113. The winch 120 has three support legs 123 which mate with depressions (not shown) formed into the top surface of post head portion 33 to provide mechanical stability for the winch. By rotating the handle in the clockwise direction as depicted in FIG. 9, cable 110 is wound about the winch reel, which forces post 30 down into the interior of housing 22. As the post 30 descends, the latch assembly 95 is actuated by means of a switch (not illustrated) to active the solenoid portion and withdraw the plunger in order to permit foot portion 31 of post 30 to pass the region of latch assembly 95. As the post 30 descends, the trigger arm 81 is biased counter clockwise by its bias spring. When the post 30 is fully retracted trigger arm 81 engages notch 85 and, solenoid 92 is deactivated, causing spring 90 to extend the working end of plunger 86 underneath the operated end 83 of trigger arm 81 to lock post 30 in place. Thereafter, the winch hook 121 is disengaged from ring 113, and the winch 120 is removed from the top surface of the post head portion 33.

Figure 10:
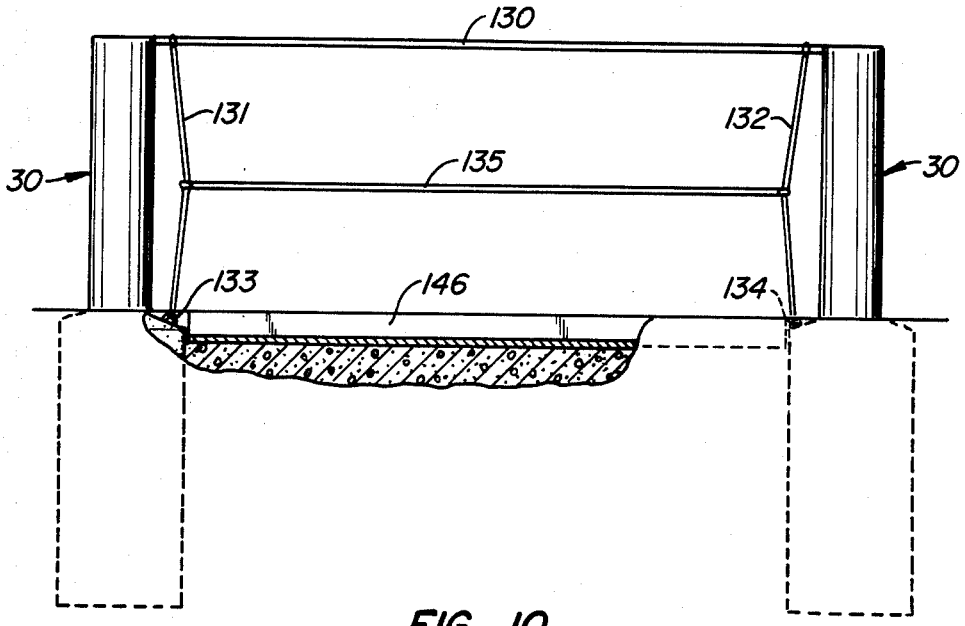
FIG. 10 is a schematic view illustrating an extended pair of posts with auxiliary cables.
Figure 11:
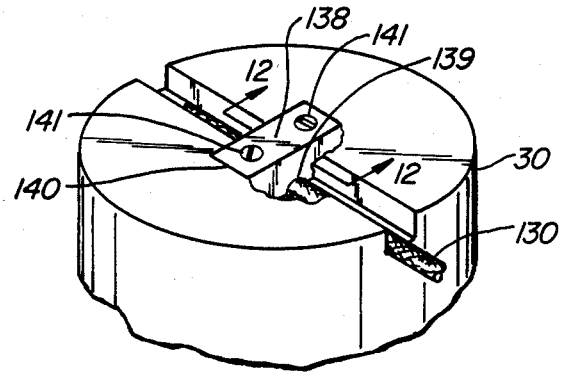
FIG. 11 is a detail perspective view illustrating attachment of a cable to the head portion of a post.
Figure 12:
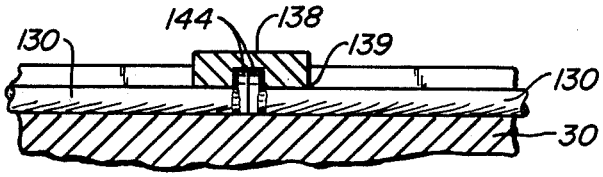
FIG. 12 is a sectional view taken along lines 12—12 of FIG. 11.

FIGS. 10–12 illustrate an accessory cable attachment useful in extending the obstruction function to the regions between the retractable posts. As seen in these Figs., a first horizontal cable 130 is connected between adjacent extended posts 30 at the top portion thereof. Secured to cable 130 at regions adjacent the junction with posts 30 is a pair of vertically extending cables 131, 132 connected at the bottom ends to an eyelet 133, 134 anchored to the concrete foundation 21 or secured to the housing 22 by means of anchor rings 133, 134. A second horizontal cable 135 is shown connected between vertical cables 131, 132 at approximately the mid-point thereof.

FIGS. 11 and 12 show one arrangement for anchoring a pair of cables 130 to the top portion of a post 30. As seen in this Fig., a channel is cut in the top surface of post 30, cables 130 are placed in the channel, and a keeper 138 having a cable groove 139 is placed in a recess 140 formed in the top surface of post 30. Keeper 138 is secured to post 30 by means of suitable fasteners 141. As seen in FIG. 12, the ends of the cables 130 are provided with a keeper stop 144 firmly secured to the cable ends by any suitable means, e.g. welding. The keeper stops 144 are received in a transverse channel cut in the undersurface of keeper 138 in order to prevent withdrawal of the cable ends from the channel.

As best shown in FIG. 10, a shallow trough 146 is preferably cut between the barrier post assemblies in order to receive cables 130-135 when posts 30 are retracted to the normal position. If desired, a small frangible cover or loose dirt can be used to cover the cables to render them unnoticeable. When the posts are extended to the position shown in FIG. 10, the cables serve as additional barriers to the passage of motorcycles, bicycles and the like between adjacent posts 30.

Figure 7B:
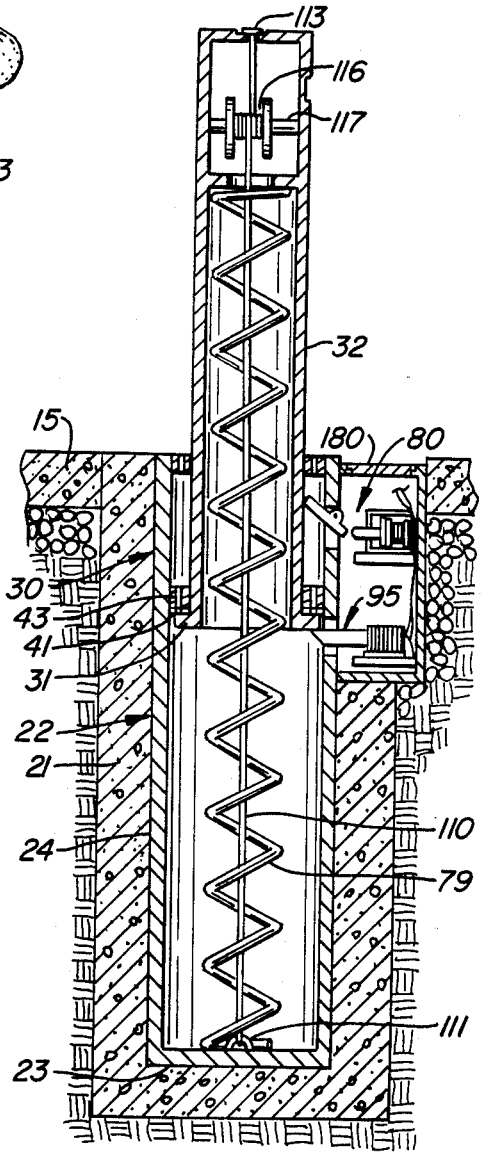
FIG. 7B is a vertical sectional view of the embodiment of FIG. 7A in the fully extended position.
Figure 13:
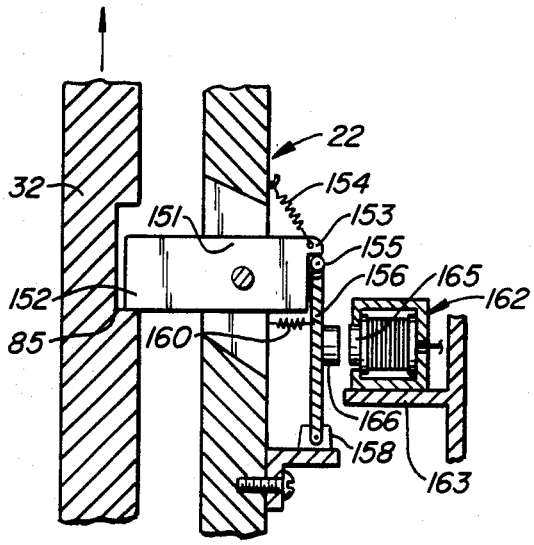
FIG. 13 is an enlarged view similar to FIG. 8 illustrating an alternate embodiment of the trigger latch assembly.
Figure 14:
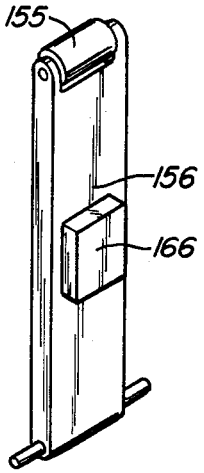
FIG. 14 is a perspective view of the latch stop of FIG. 13.

FIGS. 13 and 14 illustrate an alternate embodiment of the upper trigger latch assembly suitable for use with the spring powered embodiment of FIGS. 7A and 7B. As seen in these Figs., a trigger arm 151 has an operating end 152 engaged with notch 85 of wall portion 32 of post 30 in the normal latched state; and an operated end 153. Operated end 153 is maintained in the attitude illustrated in FIG. 13 by means of a roller bearing 155 mounted on the upper end of a latch stop 156. Latch stop 156 is pivotably mounted in a pair of pivot sockets formed in an outwardly extending bracket 158 secured to housing 22. Latch stop 156 is biased in the radially inward direction by means of a spring 160 coupled between latch stop 156 and a fixed reference point on housing 22. An electromagnet 162 is secured to a fixed ledge 163 adjacent the latch stop 156. Electromagnet 162 has a pole piece 165 positioned adjacent a magnetizable element 166 secured to the outer surface of latch stop 156.

In operation, when electromagnet 162 is energized, latch stop 156 is attracted to pole piece 165, thereby pivoting latch stop 156 about the lower pivot in socket 158. When the roller bearing 155 has travelled a sufficient radially outward distance, the operated end 153 of trigger arm 151 is released, permitting trigger arm 151 to rotate in the clockwise direction and release the post 30. When the post is retracted within housing 22, trigger arm 151 is biased by spring 154 in the counter-clockwise direction and relatches the post by engagement in notch 85. At this time, spring 160 forces the latch stop 156 to the position illustrated in FIG. 13 in which roller bearing 155 bears on the operated end 153 of trigger arm 151.

Figure 15:
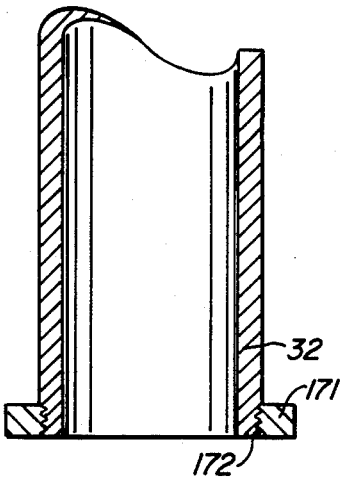
FIG. 15 is a sectional view of the lower end of the post illustrating an alternate embodiment of the invention.

In some applications it can be useful to provide the capability of completing removing barrier post 30 from the housing 22. To facilitate removal of post 30, the arrangement illustrated in FIGS. 15 and 16 may be employed. With reference to FIG. 15, the foot portion of post 30 comprises an internally threaded base ring 171 which threadably engages the externally threaded lower end 172 of post wall section 32. Base ring 171 is provided with a pair of notches similar to notches 61 (see FIG. 3).

Figure 16:
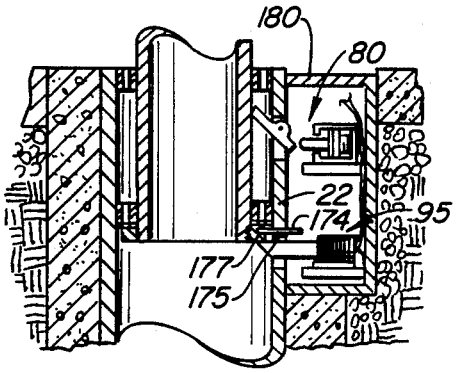
FIG. 16 is a sectional view illustrating operation of the alternate embodiment of FIG. 15.

With reference to FIG. 16, when the post 30 is in the fully extended position an abutment rod or bar 174 is manipulated radially inwardly of housing 22 through an aperture 175 to engage a notch 177 formed in base ring 171. With the base ring thus secured against rotation, the post 30 can be unscrewed from the base ring 171 and removed completely, thus providing access to the interior of housing 22. Installation of post 30 is the reverse of removal. To facilitate engagement of rod 175 with notch 177, a removable cover (not illustrated) may be provided for the latch assembly enclosure 180.

As will know be apparent, the invention affords a rapidly deployable substantial barrier against unauthorized intrusion into a protected area. Further, the assemblies can be activated from a number of different control sites, such as one or more sentry posts 12 and the actual protected building or site 10. Further, when in the retracted, normal state the roadway is essentially unaffected by the presence of the barrier system and has a effectively normal appearance to the uninitiated. In addition, the individual barrier post assemblies can be installed relatively quickly and at nominal expense.

While the above provides a full and complete disclosure of the invention, various modifications, alternate constructions and equivalents may be employed without departing from the spirit and scope of the invention. For example, although one explosive and one spring based propulsion system have been disclosed, other equivalent propulsion systems may be employed, such as an explosive charge propulsion system using a shotgun type cartridge and associated firing pin, a spring propulsion system using a different spring configuration, a compressed air propulsion source or a hydraulic propulsion source. In addition, while the invention has been disclosed for principal use in erecting a barricade against motor vehicles, the invention may be used for crowd control purposes by adding a flexible durable sheet to the arrangement of FIG. 10 or including additional horizontal and vertical cables, or both. Similarly, the invention may be used in the normally extended state along with a sheet of camouflage material to hide an escape way through a building or a tunnel in a hillside. Further, while the post array shown in FIG. 1 has been described as providing a vehicle blocking function, this array and other configurations may be employed to trap a vehicle within a perimeter, by selective actuation of the posts shown in FIG. 1 or by actuation of all posts in a rectangular or other geometrical array.

In some applications, the force of spring 79 may be sufficient to retain post 30 in the extended position. In such applications lower latch assembly 95 may be eliminated, if desired. In still other applications, particularly those utilizing a spring 79 with a relatively light spring force, the cable and winch retracting mechanism may be dispensed with and the post 30 may be retracted by simply releasing lower latch assembly 95 and standing on the top of the post. In still other installations, the post 30 may be retracted by placing a ramp made from steel or a wooden plank over the top of the post 30 and driving a vehicle up the ramp to compress the spring 79. Other retraction techinques will occur to those skilled in the art. In addition, while cap 35 has been illustrated as secured to head portion 33 of post 30 by means of fasteners 36, other suitable arrangements may be employed, e.g., adhesive bonding, a threaded outer flange or the like. Therefore, the above should not be construed as limiting the invention, which is defined by the appended claims.

What is claimed is:

1. A barrier system for controlling access to a site, said system comprising:

a plurality of rapidly erectable barrier post assembly means embedded in the earth at preselected locations relative to the site to be protected, each said barrier post assembly means including a rigid barrel housing means having a lower floor portion, an upper mouth portion located adjacent the surface of the earth, and a stop member located at a position intermediate the lower floor portion and the mouth portion; a rigid post means confined within said barrel housing means, said post means having a foot portion normally positioned on said lower floor portion, a head portion normally located adjacent said mouth portion of said barrel housing means, and an abutment member engageable with said stop member when said post means is extended above the surface of the earth; and remotely actuatable stored energy means for rapidly propelling said rigid post means from the normal position to the extended position; and means for simultaneously actuating a plurality of stored energy means.

2. The invention of claim 1 wherein said stop member comprises a pair of lugs extending inwardly of the inner surface of said barrel housing means.

3. The invention of claim 1 wherein said stop member includes a resilient member mounted on the lower surface thereof to cushion the impact with said abutment member.

4. The invention of claim 1 wherein said barrier post assembly means includes a latch means; and wherein said post means abutment member is engageable with said latch means.

5. The invention of claim 4 wherein said stop member is positioned above said latch means.

6. The invention of claim 4 wherein said latch means comprises a lateral blind recess formed in said barrel housing means, a slidable latch member received in said recess, and means for biasing said latch member inwardly of said barrel housing means.

7. The invention of claim 6 wherein said latch means further includes keeper means for limiting inward motion of said latch member.

8. The invention of said 4 wherein said latch means includes a trigger latch assembly for normally latching said post means in the normal position, and means for releasing said trigger latch assembly to enable extension of said post means.

9. The invention of claim 1 further including means for anchoring said plurality of erectable barrier post assembly means into the earth.

10. The invention of claim 9 wherein said anchoring means comprises a concrete foundation.

11. The invention of claim 1 wherein said foot portion of said post means comprises a peripheral flange having a pair of notches each wider than said latch means for enabling said post means to be restored to the normal position after extension.

12. The invention of claim 1 wherein said post means includes a protective cap secured to said head portion for shielding the interior of said barrier post assembly means from ambient.

13. The invention of claim 1 wherein said propelling means comprises an explosive charge positioned within said barrier post assembly means.

14. The invention of claim 13 wherein said explosive charge is suspended from the head portion of said post means.

15. The invention of claim 1 wherein said propelling means comprises a spring means positioned between said post means and said housing means for urging said post means to the extended position.

16. The invention of claim 15 wherein said post means has a hollow interior and wherein said spring means is positioned within said housing interior.

17. The invention of claim 15 further including means for forcibly retracting said post means within said housing means after extension of said post means.

18. The invention of claim 17 wherein said retracting means includes a flexible cable means secured at one end to said lower floor portion of said housing means and coupled at the other end thereof to said head portion of said post means.

19. The invention of claim 18 wherein said retracting means further includes a cable reel positioned within said post means, and a portion of said cable means is wound about said cable reel for storage when said post means is in the normal position.

20. The invention of claim 18 wherein said retracting means further includes a detachable winch means adapted to be placed on the exposed surface of said head portion of said post means, said winch means having a hook for engaging the other end of said flexible cable means.

21. The invention of claim 1 further including a plurality of cables coupled between preselected ones of said barrier post assembly means for providing additional barriers interstitially thereof when said post means are extended.

22. The invention of claim 8 wherein said trigger latch assembly includes a latch member releasably engaged with said post means, and wherein said releasing means includes a lock plunger releasably engaged with said latch member and solenoid means for retracting said lock plunger when extension of said post means is desired.

* * * * *